United States Patent [19]

Shimizu

[11] Patent Number: 4,893,993

[45] Date of Patent: Jan. 16, 1990

[54] LUBRICATION SYSTEM FOR A REFRIGERANT COMPRESSOR

[75] Inventor: Keiichi Shimizu, Isesaki, Japan

[73] Assignee: Sanden Corporation, Gunma, Japan

[21] Appl. No.: 80,610

[22] Filed: Aug. 3, 1987

[30] Foreign Application Priority Data

Aug. 1, 1986 [JP] Japan ..... 61-118789[U]

[51] Int. Cl.[4] ..... F04B 1/14

[52] U.S. Cl. ..... 417/269; 184/6.17

[58] Field of Search ..... 417/269, 222 S; 184/6.17

[56] References Cited

U.S. PATENT DOCUMENTS

| | | | |
|---|---|---|---|
| 2,797,647 | 7/1957 | Floraday | 417/269 |
| 3,712,759 | 1/1973 | Olson, Jr. | 417/269 |
| 4,101,249 | 7/1978 | Nakayama et al. | 417/269 |
| 4,101,250 | 7/1978 | Nakayama et al. | 417/269 |
| 4,283,166 | 8/1981 | Hiraga . | |
| 4,326,838 | 4/1982 | Kawashima | 417/269 |
| 4,444,549 | 4/1984 | Takahashi et al. | 417/269 |
| 4,586,876 | 5/1986 | Kato et al. | 417/269 |
| 4,685,866 | 8/1987 | Takewaka | 417/270 |
| 4,712,982 | 12/1987 | Inagaki et al. . | |
| 4,729,718 | 3/1988 | Ohta et al. | 417/222 |

FOREIGN PATENT DOCUMENTS

| | | | |
|---|---|---|---|
| 123716 | 9/1979 | Japan | 417/269 |
| 167179 | 7/1986 | Japan | 417/269 |

*Primary Examiner*—Leonard E. Smith

*Attorney, Agent, or Firm*—Banner, Birch, McKie & Beckett

[57] ABSTRACT

A slant plate type compressor such as a wobble plate type refrigerant compressor is disclosed. The compressor includes a compressor housing having a cylinder block provided with a plurality of cylinders, and a crank chamber adjacent the cylinder block. A front end plate is attached on one end surface of the compressor housing. A cylinder head is formed on the other end surface of the compressor housing having a suction chamber and a discharge chamber. The suction chamber surrounds the discharge chamber. A refrigerant inlet port is formed on the compressor housing and introduces refrigerant directly into the crank chamber. A plurality of communication holes are formed through the cylinder block to communicate between the crank chamber and the suction chamber. Therefore, lubricating oil mixed with refrigerant is sucked into the crank chamber and lubricates the moving parts of the compressor. The accumulated oil then flows along with refrigerant from the crank chamber to the suction chamber through the communication holes. As a result, the maximum compression capacity is maintained, while adequate lubrication is performed without a sump portion.

7 Claims, 3 Drawing Sheets

LUBRICATION SYSTEM FOR A REFRIGERANT COMPRESSOR

TECHNICAL FIELD

The present invention relates to a refrigerant compressor. More particularly, the present invention relates to a refrigerant compressor which achieves sufficient lubrication without an oil sump portion.

BACKGROUND OF THE INVENTION

A conventional slant plate compressor such as a wobble plate type compressor includes a compressor housing, a front end plate, and a cylinder head. A cylinder blck and a crank chamber are formed in the compressor housing. The front end plate is attached to one end surface of the compressor housing to cover the opening of the housing. The cylnder head is disposed on the other end surface of the compressor housing adjacent the cylinder block through a valve plate. A suction chamber and a discharge chamber are formed within the cylinder head. A plurality of cylinders are formed in the cylinder block and pistons are reciprocatingly placed with the cylinders. A drive shaft extends within the compressor housing, and is rotatably supported within an opening in the front end plate through a bearing. A drive mechanism for reciprocating the pistons is mounted on the drive shaft in the crank chamber. The drive mechanism includes a rotating portion and a mechanism for converting rotational motion into transitional motion. Each piston is coupled to the drive mechanism through a connecting rod.

In slant plate type compressors, both the wobble plate and the swash plate are disposed at a slant angle and drivingly couple the pistons to the drive source. However, the wobble plate nutates only. The swash plate both nutates and rotates. The term slant plate type compressor will be used to refer to any type of compressor, including wobble and swash plate types, which use a slanted plate or surface in the drive mechanism.

In a conventional refrigerant compressor, while the refrigerant gas is compressed by the reciprocating motion of the pistons, moving parts of the compressor must be lubricated by lubricating oil. One lubricting method for a wobble plate type compressor is disclosed in U. S. Pat. No. 3,712,759. In this compressor, refrigerant containing lubricating oil is directly introduced into the crank chamber from the external refrigeration circuit through an inlet port. A suction chamber and a discharge chamber are formed in the cylinder head; the suction chamber is located at the center of the cylinder head, and the discharge chamber is located around the suction chamber. A communication hole which communicates between the crank chamber and the suction chamber is formed within a central portion of the cylinder block. The refrigerant containing the lubricating oil directly enters the crank chamber and lubricates the moving parts of the compressor. Lubricating oil is spread on the inner wall surface of the crank chamber by the centrifugal force of a rotor and gradually accumulates in the bottom portion of the crank chamber.

However, this compressor does not have adequate lubricating oil circulation. Therefore, additional lubricating oil is needed to prevent inadequate lubrication of the moving parts of the compressor, and additional lubricating oil may be required. Moreover, if too much lubricating oil or the like exists in the refrigeration circuit, the refrigerating capacity of the refrigeration circuit decreases.

SUMMARY OF THE INVENTION

It is a primary object of the present invention to provide a refrigerant compressor having sufficient lubrication without the use of an oil sump portion and with a minimum amount of lubricating oil.

It is another object of the present invention to provide a refrigerant compressor without an oil sump portion with an improved refrigerating capacity of the refrigeration circuit.

A refrigerant compressor according to one embodiment of this invention includes a compressor housing which has a cylinder block provided with a plurality of cylinders and a crank chamber adjacent the cylinder block. A piston is slidably fitted within each of the cylinders and is reciprocated by the nutating motion of a wobble plate. The wobble plate is placed proximate the slant surface of a rotor which is fixed on a drive shaft. An inlet port is formed on the compressor housing to communicate directly with the crank chamber. A cylinder head is disposed on one end portion of the housing and includes a suction chamber and a discharge chamber. The suction chamber is formed within the cylinder head and surrounds the discharge chamber. A plurality of communication holes are formed through the cylinder block at the outer portion of the cylinder block adjacent the inner wall surface of the compressor housing. These communication holes communicate between the crank chamber and the suction chamber.

Various additonal advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 4:
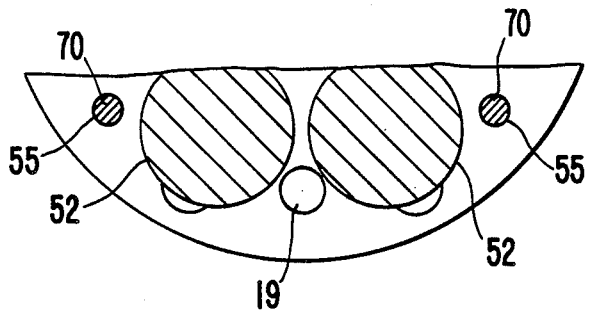
FIG. 4 is a partial cross-sectional view of the compressor of FIG. 1 taken along line III—III.

Referring to the figures, a refrigerant compressor in accordance with one embodiment of this invention is shown. The compressor includes front end plate 1, compressor housing 2, and an end plate in the form of cylinder head 3. Crank chamber 4 and cylinder block 5 are disposed within compressor housing 2 adjacent each other. Front end plate 1 is attached to one end surface of compressor housing 2 to cover the opening of housing 2. One end portion of cylinder block 5 is covered by cylinder head 3 at the other end of compressor housing 2 through valve plate 6. Cylinder head 3 and valve plate 6 are disposed on housing 2 through screws disposed through holes 54 and 55 disposed in cylinder head 3 and housing 2, respectively. Screws or fasteners 70 are shown as being disposed in holes 55 in FIG. 4.

Drive shaft 7 is rotatably supported within opening 11 of front end plate 1 through bearing 8 and extends within crank chamber 4. A wedge-shaped rotor 9 is affixed on an inner end of drive shaft 7 to be rotated therewith. Rotor 9 is axially rotatably supported on the inner end surface of front end plate 1 through thrust bearing 10. Rotor 9 is also provided with a slant surface proximate the surface of wobble plate 12 with thrust bearings 14 disposed therebetween.

Wobble plate 12 is nutatably but nonrotatably supported on hinge ball 15 which is seated at one end of supporting rod 16. Supporting rod 16 includes shank portion 161 and bevel gear portion 162 which has a seat for hinge ball 15 at its center. Shank portion 161 extends into central bore 51 formed in the central portion of cylinder block 5. Supporting rod 16 does not rotate and prevents wobble plate 12 from rotating by the engagement of bevel gear portion 162 with bevel gear 13 mounted on wobble plate 12. Spring 161*a* urges supporting rod 16 to the left.

Suction chamber 31 and discharge chamber 32 are formed within cylinder head 3. Discharge chamber 32 is located at the center of cylinder head 3 and suction chamber 31 surrounds discharge chamber 32.

Figure 1:
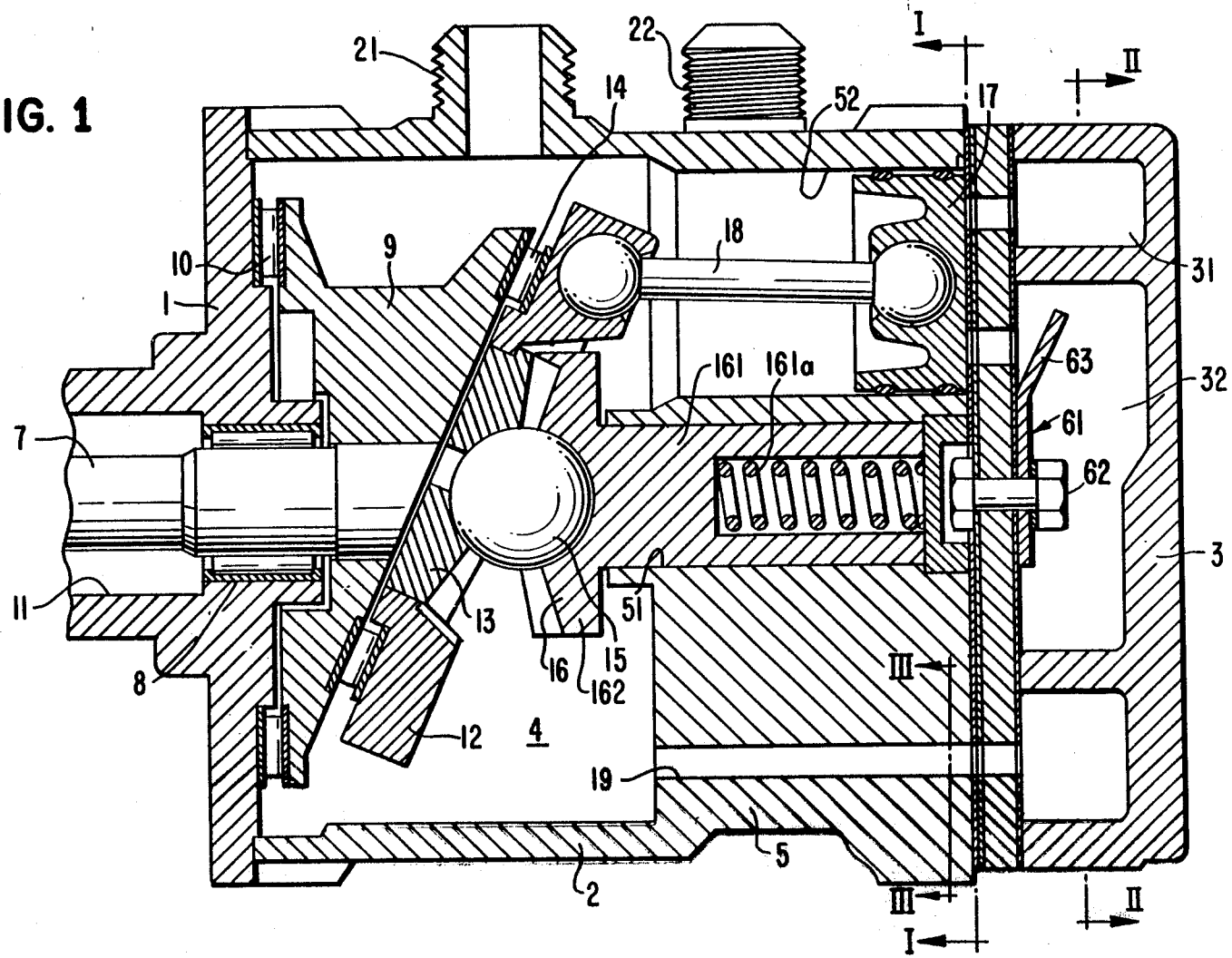
FIG. 1 is a cross-sectional view of a refrigerant compressor in accordance with one embodiment of this invention.
Figure 2:
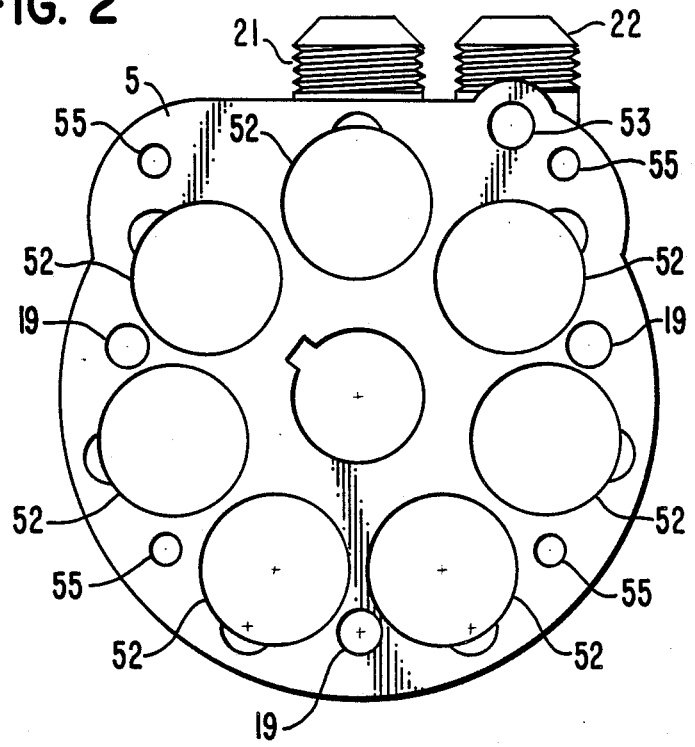
FIG. 2 is a cross-sectional view of the compressor of FIG. 1 taken along line I—I.

A plurality of cylinders 52, one of which is shown in FIG. 1, are equiangularly formed in cylinder block 5, and piston 17 is slidably fitted within each cylinder 52. Piston 17 is coupled to wobble plate 12 through connecting rod 18 through ball joints.

A plurality of communication holes 19 are also equiangularly formed through cylinder block 5 along the inner circumference of cylinder housing 2 to provide fluid communication between crank chamber 4 and suction chamber 31.

Figure 3:
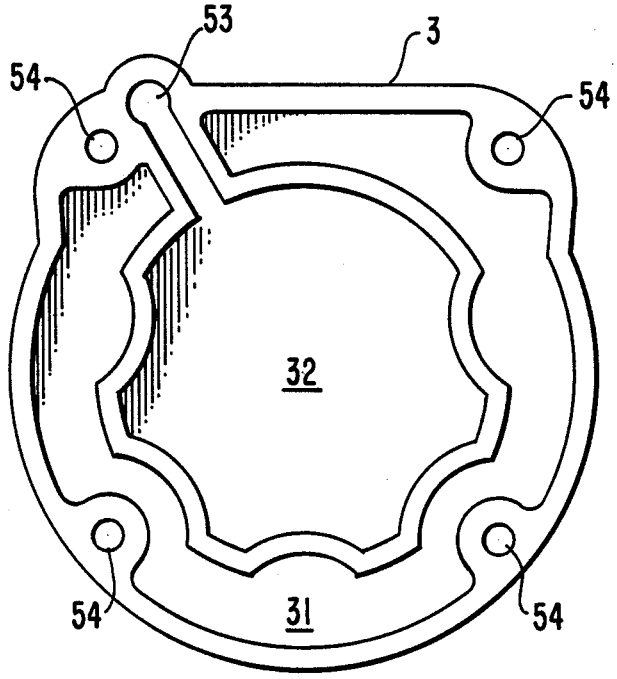
FIG. 3 is a cross-sectional view of the compressor of FIG. 1 taken along line II—II.

Inlet port 21 is disposed on compressor housing 2 to provide fluid communication directly between the refrigeration circuit and the interior of crank chamber 4. Outlet port 22 is disposed on compressor housing 2 to communicate with discharge chamber 32 through passageway 53, as best shown in FIG. 3, which is formed within cylinder block 5. Outlet port 22 is disposed on housing 2 near inlet port 21 to save space and facilitate connecting the compressor to an external refrigeration circuit.

Discharge valve mechanism 61 is mounted centrally on valve plate 6 within discharge chamber 32 as shown in FIG. 1. Discharge valve mechanism 61 includes mounting bolt 62 and a plurality of valve members 63 (only one valve member 63 is shown in FIG. 1 corresponding to the one illustrated cylinder 52). Each valve member 63 opens and closes the discharge port of a respective cylinder. Because discharge chamber 32 is formed in the radially central portion of cylinder head 3, all valve members 63 for each of cylinders 52 may be fixed at one central location by bolt 62. This single discharge valve mechanism 61, integrally having a plurality of valve members 63 and requiring only one bolt 62 to attach the valve mechanism on valve plate 6, simplifies the assembly of the compressor and reduces the number of required parts.

In operation, the refrigerant containing lubricating oil is introduced directly into the interior of crank chamber 4 through inlet port 21. The refrigerant containing lubricating oil fills crank chamber 4 and lubricates each of the moving parts of the compressor. When refrigerant contacts rotor 9, the lubricating oil is separated from the refrigerant and adheres to the outer surface of rotor 9. This lubricating oil is splashed against the inner wall surface of crank chamber 4 by the centrifugal force of rotor 7 and then accumulates in the bottom portion of crank chamber 4. Then, the lubricating oil and refrigerant flow into suction chamber 31 through communication holes 19. The number and diameter of communication holes 19 preferably is large to reduce the pressure loss of refrigerant.

The moving parts of this compressor that are disposed within the crank chamber are lubricated easily and directly by introduced refrigerant because the refrigerant contains the lubricating oil. Also, the temperature of introduced refrigerant is lower due to reduced friction, and the compressor parts within the crank chamber are kept cooler and therefore last longer. Moreover, because the amount of lubricating oil in the system can be minimized at the minimum amount required, the maximum capacity of the compressor can be realized.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A slant plate refrigerant compressor for use in a refrigerant circuit comprising:

a compressor housing having a cylinder block which is provided with a plurality of cylinders, the inner wall surface of said housing forming the outer wall of a crank chamber which is adjacent to said cylinder block, said housing haveing a plurality of housing fastener holes for receiving a fastener;

a front end plate disposed on one end of said housing;

a rear end plate disposed on the other end of said housing adjacent said cylinder block, said rear end plate including a discharge chamber disposed at its center, and a suction chamber disposed around said discharge chamber, said rear end plate having a plurality of end plate fastener holes for receiving a fastener, said end plate fastener holes being aligned with said housing fastener holes;

a piston slidably fitted within each of said cylnders;

a drive mechanism disposed in said crank chamber and coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft;

an inlet port formed on said housing to provide fluid communication directly into said crank chamber from the external refrigerant circuit; and a plurality of communication holes formed through an outer portion of said cylinder block and extending from a location adjacent said outer wall of said crank chamber to said suction chamber to provide communication therebetween, said communication holes being formed spaced from and independent of said housing fastener holes and said end plate fastener holes, to thereby reduce refrigerant pressure loss.

2. The refrigerant compressor of claim 1 wherein said member comprises an inclined plate and said coupling means further comprises a wobble plate disposed adjacent said inclined plate.

3. The refrigerant compressor of claim 1 wherein an outlet port is formed on said housing adjacent to said inlet port.

4. A slant plate type refrigerant compressor for use in a refrigerant circuit comprising:

a compressor housing having a cylinder block which is provided with a plurality of cylinders, the inner wall of said housing forming the outer wall of a crank chamber which is adjacent to said cylinder block, said housing having a plurality of housing fastener holes for receiving a fastener;

a front end plate disposed on one end of said housing;

a rear end plate disposed on the other end of said housing adjacent said cylinder block, said rear end plate including a discharge chamber disposed at its center, and a suction chamber disposed around said discharge chamber, said rear end plate having a plurality of end plate fastener holes for receiving a fastener, said end plate fastener holes being aligned with said housing fastener holes;

a piston slidably fitted within each of said cylinders;

a drive mechanism disposed in said crank chamber and coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft;

an inlet port formed on said housing to provide fluid communication directly into said crank chamber from the external refrigerant circuit;

a plurality of unobstructed communication holes formed through an outer portion of said cylinder block and extending from a location adjacent said outer wall of said crank chamber to said suction chamber to provide communication therebetween, said communication holes being formed spaced from and independent of said housing fastener holes and said end plate fastener holes, to thereby reduce refrigerant pressure loss; and said crank chamber being serially positioned between the inlet port and each unobstructed communication hole.

5. The refrigerant compressor of claim 4 wherein a fastener is disposed in each housing fastener hole.

6. The refrigerant compressor of claim 4 wherein said member comprises an inclined plate and said coupling means further comprises a wobble plate disposed adjacent said inclined plate.

7. The refrigerant compressor of claim 4 wherein an outlet port is formed on said housing adjacent to said inlet port.

* * * * *